United States Patent [19]

Yeh

[11] Patent Number: 4,682,484

[45] Date of Patent: Jul. 28, 1987

[54] TUMBLER PLATE CYLINDER LOCK

[76] Inventor: Ching-Hsuan Yeh, 4th Floor, No. 19, Lane 187, Nei Hu Road, Sec. 3, Taiwan, Taipei, Taiwan

[21] Appl. No.: 852,443

[22] Filed: Apr. 15, 1986

[51] Int. Cl.[4] ..... E05B 29/08

[52] U.S. Cl. ..... 70/364 R; 70/377; 70/DIG. 54

[58] Field of Search ..... 70/364 R, 376, 377, 70/392, DIG. 54, DIG. 55

[56] References Cited

U.S. PATENT DOCUMENTS

| | | | |
|---|---|---|---|
| 2,047,966 | 7/1936 | Jacobi | 70/364 R |
| 2,155,734 | 4/1939 | Olson | 70/364 R |
| 2,453,066 | 11/1948 | Gabrielsen | 70/364 R |
| 3,777,521 | 12/1973 | Lipschutz | 70/364 R |

*Primary Examiner*—Robert L. Wolfe

*Attorney, Agent, or Firm*—Michael N. Meller

[57] ABSTRACT

A tumbler plate cylinder lock having a hollow housing, a cylinder rotatably mounted into the housing, and a plurality of sheet-like locking members, or tumbler plates, snugly fitted in the cylinder. Each two locking members is interlocked by an arciform-shaped spring in such a manner that one extension of each locking member will be urged to extend out of a corresponding passage formed on the peripheral wall of a center bore of the cylinder and into a respective longitudinal slot formed on the inner peripheral surface of the housing, thus the cylinder is prevented from turning relative to the housing, whereby the cylinder lock is held in a locked position. Each locking member has a central opening for receiving a key having a shank provided with a plurality of depressions, and the central opening has a side wall provided with a projection to match a corresponding depression of the key shank.

3 Claims, 12 Drawing Figures

TUMBLER PLATE CYLINDER LOCK

BACKGROUND OF THE INVENTION

This invention relates to a cylinder lock, in particular to a tumbler plate cylinder lock which has a plurality of sheet-like locking members or tumbler plates to perform the locking action.

As is well known, conventional cylinder locks usually employ a plurality of pin tumblers of variable lengths as locking elements which are pressed down from cavities provided in a housing by springs to engage with holes in a cylinder rotatably mounted in the housing. Such a conventional design requires not only many drilling operations to form these cavities or holes, but also makes the positioning of drilling difficult since a great number of holes must be formed to receive these pin tumblers having upper and lower segments. Further, as each cavity or hole in the housing and the cylinder has to be installed with one spring, one upper segment and one lower segment, the assembly process is so delicate that the assembly rate cannot be raised easily. Accordingly, the manufacturing cost of conventional cylinder locks cannot be greatly reduced due to these problems.

The main object of this invention is to provide an improved cylinder lock which has fewer parts to simplify the manufacture and assembly process in order to reduce the manufacturing cost thereof.

Another object of this invention is to provide a cylinder lock in which a plurality of sheet-like locking members or tumbler plates, each two being arranged in a pair, are provided to effectively inhibit the lock device from being picked or opened without the use of a proper key.

SUMMARY OF THE INVENTION

The cylinder lock according to this invention includes a hollow housing having a first center bore, a cylinder rotatably mounted in the first center bore, the cylinder having a second center bore and being provided with a plurality of passages on the inner peripheral wall thereof and communicating with the second center bore, a plurality of locking members snugly fitted in the second center bore, one locking member being provided with a center opening and two extensions each extending longitudinally and outwardly from the center opening a projection, at one side wall of the center opening extending along the longitudinal axis thereof and having a length corresponding to the depth of a depression formed on the outer peripheral surface of a shank of a key adapted to lock and open the cylinder lock, and a plurality of spring members, one spring member being interconnected between each two locking members to urge a pair of locking members in opposite directions to move one extension of a corresponding locking member through a respective passage and into a respective longitudinal slot formed on the inner peripheral wall of the housing to prevent the cylinder from turning relative to the housing, whereby the cylinder lock is held in a locked position. When a matching key is inserted into the cylinder with its depressions formed on the shank being engaged with the corresponding projections, each pair of locking members will be urged to move against the elastic force of the spring member inter-connected therebetween to cause its one extension to retract back into the corresponding passage, and the cylinder thus can be turned relative to the housing when the key is manually turned.

In one preferred embodiment, the passages formed on the cylinder are a plurality of openings being vertically aligned and spaced apart from each other and each passage having a shape adapted to loosely accommodate one extension of the locking members so as to provide means for spacing and guiding the locking members. In another embodiment, the passages are vertical slots equally spaced around the integral peripheral wall of the cylinder to divide the same into a plurality of equal arciform portions, each arciform portion being provided with a plurality of annular grooves on the outer peripheral surface thereof, and one snap member is engaged into each annular groove with its opposite ends bent inwardly to abut against the corresponding side surface of the arciform portion and extending into the second center bore to support the corresponding locking member, so as to provide means for spacing and guiding the locking members.

DETAILED DESCRIPTION OF THE PREFERRED EMBODIMENTS

Figure 2:
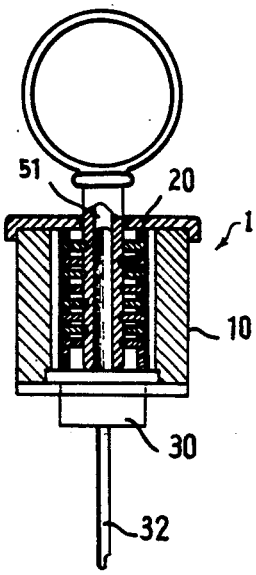
FIG. 2 is a view similar to FIG. 1, showing an unlocked state when a matching key is inserted thereinto.
Figure 1:
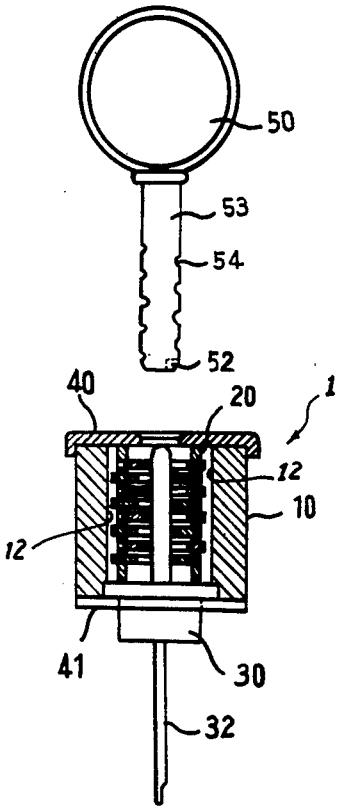
FIG. 1 is a side elevational sectional view of a cylinder lock of this invention, showing its locked state when a matching key is not inserted.

Referring to FIGS. 1 and 2, the cylinder lock 1 of this invention mainly comprises a stationary housing 10, a cylinder 20 rotatably mounted in housing 10, a base 30 operatively connected to cylinder 20 for actuating the same to turn, and an upper cover 40 and a lower cover 41 fixedly mounted at opposite ends of housing 10.

Figure 4:
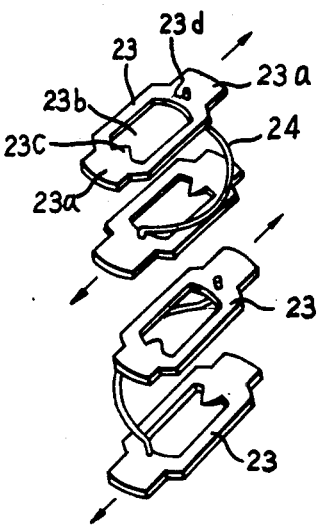
FIG. 4 is a perspective view of locking members thereof.
Figure 3:
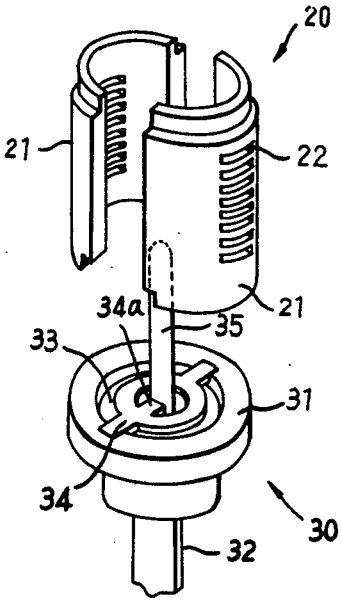
FIG. 3 is a partly exploded perspective view of the cylinder and base shown in FIGS. 1 and 2.
Figure 7:
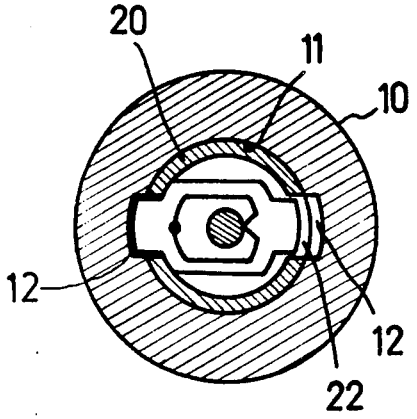
FIG. 7 is a cross-sectional view of a cylinder lock of this invention illustrating its locked state.

Housing 10 is a cylindrical body having a center bore 11 (FIG. 7), whose inner peripheral wall is provided with two opposite longitudinal slots 12 as clearly indicated in FIG. 7. As shown in FIGS. 3 and 4, hollow cylinder 20 is composed of two semi-circular members 21, each of whose side walls is provided in the center portion thereof with a plurality of horizontally oriented openings 22, preferably of a rectangular shape. The rectangular openings 22 are vertically aligned with each other in the longitudinal direction of semi-circular member 21, and the distance between each two adjacent openings 22 may be predetermined as desired, which distances may be equal or unequal to each other in order to permit different locking combinations. Also, one end of base 30 is integrally formed with an annular base portion 31, while the other end of base 30 is fixedly connected with an actuating lever 32 which is operatively connected to a lock bolt (not shown) of the door lock to actuate the lock bolt to move when base 30 is turned. On the top of base 30 is provided a circular recess 33, an annular actuating member 34 and a center post 35. Center post 35 is integrally formed in recess 33 and located at the center of recess 33 or actuating member 34, namely, the axis of center post 35 and annular actuating member 34 are coaxial with the axis of base 30. On the inner peripheral surface of annular actuating member 34 a key post **34*a* is provided for engagement with a notch 52 formed in the leading edge of a hollow shank 53 of key 50 as shown in FIG. 1. As viewed mainly from FIG. 3, it is readily understood that the clearance formed between the inner periphery of annular base portion 31 and the outer periphery of actuating member 34 is adapted to allow the lower ends of the complementary semi-circular members 21** to be engaged therein.

Figure 6:
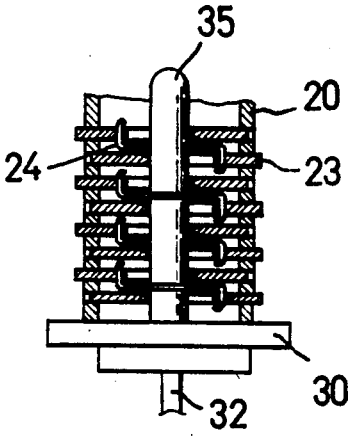
FIG. 6 is a fragmentary enlarged view of FIG. 1, showing the position of the locking members when the cylinder lock is in a locked state.
Figure 5:
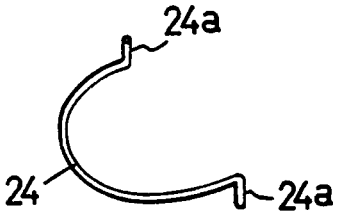
FIG. 5 is a perspective view of a spring member of FIG. 4.

Now referring to FIG. 6, within cylinder 20 there is provided a plurality of locking members 23, each one being substantially in a rectangular shape. Each locking member 23, as shown in FIG. 4, is made by performing a punching operation on a metallic sheet metal such as a copper plate and is integrally formed with two extensions **23*a* at its opposite ends, a substantially rectangular-shaped center opening 23*b* in its main body, a projection 23*c* projecting inwardly from one side wall of opening 23*b* toward the center of locking member 23, and a throughhole 23*d* located adjacent to another side wall of center opening 23*b* opposite to said projection 23*c*. Projection 23*c* and throughhole 23*d* both are preferably located along the longitudinal axis of locking member 23, and the length of projection 23*c* of each locking member 23 is equivalent to the depth of the corresponding depressions 54 formed on the outer periphery of shank 53 of key 50 (FIG. 1). Further, each pair of locking members 23 are interlocked by a substantially arciform spring 24 such that they overlap one above the other with a proper distance formed therebetween which is equivalent to the distance between the corresponding two rectangular openings 22 in semi-circular members 21. The opposite ends 24*a* (see FIG. 5) of spring 24 extending in a direction substantially perpendicular to the body of spring 24 will be bent after they are respectively inserted through hole 23*d* of corresponding locking member 23 to assure that each two locking members 23 will be interlocked in a pair. In this way, each pair of interlocked locking members 23 will be biased by spring 24 in opposite radial directions so that each locking member extends one extension 23*a* out of the corresponding opening 22 of semi-circular member 21, as shown in FIGS. 1 and 5. From the above, it is to be noted that the cylinder lock of this invention may have an infinite variety of locking combinations by means of varying the distance between each two adjacent openings 22 of cylinder 20, i.e., the distance between each pair of locking members 23, and the length of projection 23*c* of each locking member 23**.

The locking and unlocking operation of the cylinder lock according to this invention will now be described. Referring again to FIGS. 1, 2 and 7, the cylinder lock of this invention is normally in a locked state as one extension **23*a* of each locking member 23 alternatively projects into one longitudinal slot 12 of housing 10 due to the bias force of spring 24 to inhibit cylinder 20 together with base 30 from turning relative to housing 10. When a matching key 50 is inserted into the slide lock 1 and slid over the center post 35 until notch 52 meshes with key post 34*a*, as shown in FIG. 2, as the depressions 54 formed on shank 53 correspond with corresponding projections 23*c* of locking members 23, each locking member 23 is caused to move against the bias force of springs 24 such that its one extension 23*a* to retracts from the corresponding longitudinal slot 12 into corresponding opening 22 with the periphery surface of extension 23*a* being flush with the outer periphery surface of semi-circular member 21. In this way the extensin 23*a* no longer obstructs relative rotation of the housing 10 and cylinder 20, and cylinder 20 together with base 30 can be turned, when key 50 is manually turned, to actuate actuating lever 32 to unlock cylinder lock 1. On the other hand, if a key which is not fit for cylinder lock 1 is inserted therein, cylinder 20 along with base 30 cannot be turned relative to housing 10 and cylinder lock 1 will be maintained in a locked state as long as there is still at least one extension 23*a* of a locking member 23 extending a longitudinal slot 12 of housing 10**.

Figure 8:
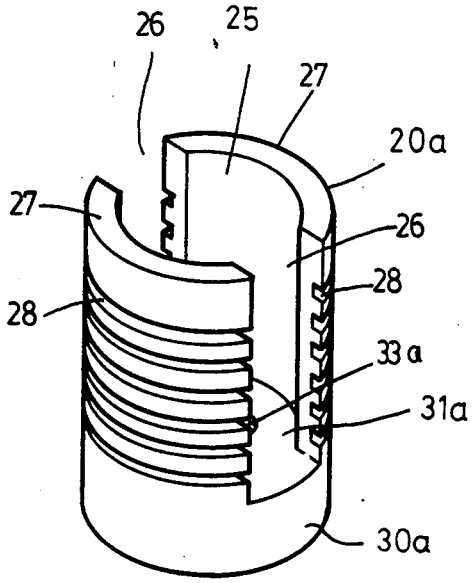
FIG. 8 is a perspective view of a cylinder of a second embodiment of this invention.
Figure 10:
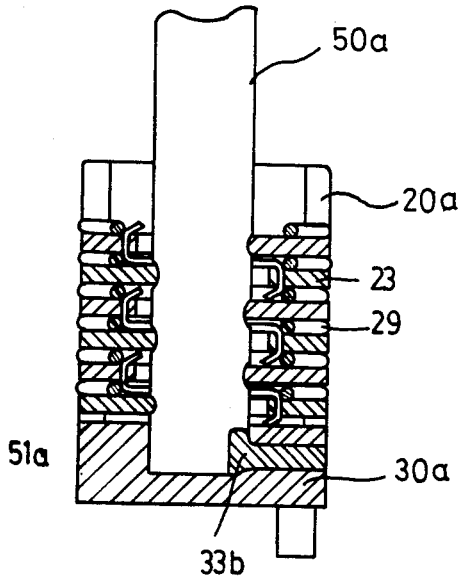
FIG. 10 is a view similar to FIG. 9 showing the unlocked state when a matching key is inserted therein.
Figure 9:
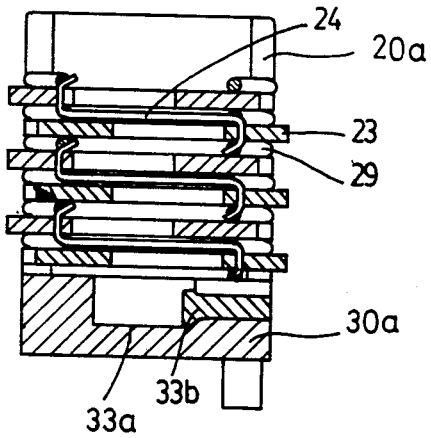
FIG. 9 is a sectional view, with locking members and snap members mounted therein, of the cylinder of FIG. 8.
Figure 11:
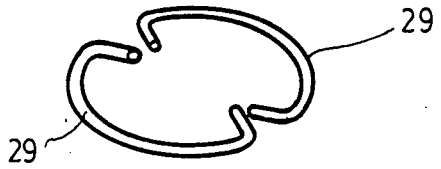
FIG. 11 is a perspective view of the snap members of FIGS. 9 and 10.
Figure 12:
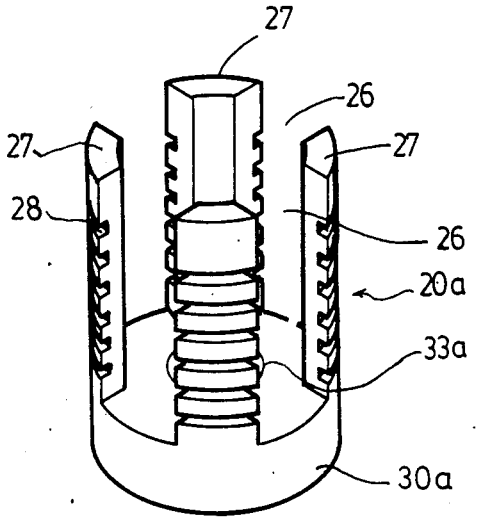
FIG. 12 is a perspective view, similar to FIG. 8, of a cylinder of a third embodiment of this invention.

To simplify the cylinder construction and to facilitate the mounting of locking members, the cylinder according to this invention may be so constructed that cylinder **20*a* and base 30*a* are both integrally formed together as a second embodiment of this invention shown in FIGS. 8 to 10. In the second embodiment of the cylinder lock of this invention, cylinder 20*a* is provided with a center bore 25, while base 30*a* is integrally formed at the lower portion of cylinder 20*a* without the provision of the above-mentioned center post. The peripheral wall of cylinder 20*a* is provided with two vertical slots 26 opposite to each other and corresponding to the above-mentioned longitudinal slots 12 of housing 10 which divide the cylinder into two arciform portions 27, with each arciform portion 27 being provided with a plurality of annular grooves 28 in its outer peripheral surface. A circular recess 33*a* having a diameter equivalent to the outside diameter of the shank of a matching key 50*a* is also formed in the top surface 31*a* of base 30*a*, and a key post 33*b* adapted to engage with notch 52*a* formed in the leading edge of solid shank 51*a* of a matching key (as shown in FIG. 10) is provided in the inner wall of circular recess 33*a*. After the above-described pairs of locking members 23 have been snugly mounted within cylinder 20*a* with their extensions 23*a* fitted in the corresponding vertical openings 26, one arciform snap member 29 made of a spring wire may be engaged in each annular groove 28 as shown in FIGS. 9 and 10. Snap member 29 has its opposite ends bent inwardly so as to abut against the side surface of the corresponding arciform portion 27 when engaged in annular groove 28. In this way snap members 29 will not only separate locking members 23 from each other, but will also act as guide members to guide locking members 23 to smoothly move along and within opening 26 when they are actuated to move by inserting a matching key into cylinder 20*a*. It is readily seen that the operating principle of the second embodiment of this invention is similar to that of the first embodiment described above, and the description of the locking and unlocking operations thereof may thus be omitted. Further, in order to increase the variations of locking combinations, the number of vertical openings 26 formed in the peripheral wall of cylinder 20***a* may be increased, for example, to four as shown in FIG. 12. With such an arrangement, it goes without saying that the number of longitudinal slots 12 formed on housing 10 should also be increased to four in order to accommodate the pairs of locking members which may be crossed with each other.

The cylinder lock of this invention may provide the following advantages as compared to conventional cylinder locks:

1. Opening 22 or 26 of cylinders 20 or 20*a* for accommodating locking members 23 may be integrally formed without the necessity of a complicated drilling operation as conventional cylinder locks require, and the manufacturing cost thus can be reduced.

2. By using sheet-like locking members 23 instead of conventional pin tumblers having upper and lower segments, the parts can be more easily prepared and fewer parts are required. It is thus possible to improve the manufacture and assembly rate, thus further reducing the manufacturing cost.

3. Each two locking members are interlocked with each other, which will effectively prevent the cylinder lock from being picked open without the use of a proper key.

What I claim is:

1. A tumbler plate clylinder lock comprising:

a housing having a first center b ore and being provided with a plurality of longitudinal slots around the inner peripheral wall thereof;

a cylinder rotatably mounted into said first center bore and being provided with a second center bore;

a plurality of locking members snugly mounted within said second center bore, each of said locking members having a center opening and two extensions extending longitudinally and outwardly from said center opening, one side wall of each of said center openings being provided with a projection extending along the longitudinal axis thereof and having a length corresponding to the depth of a depression formed on the outer periphery surface of a shank of a key adapted to lock and open said cylinder lock;

guide means for spacing and guiding said locking members; and a plurality of arciform shaped spring members, each spring member being interconnected between each two of said locking members to urge said pair of locking members in opposite directions to move along said guide means and cause one extension of a corresponding locking member to engage with a respective one of said longitudinal slots to prevent said cylinder from turning relative to said housing.

2. A cylinder lock as recited in claim 1, wherein said guide means comprises, a plurality of openings vertically aligned and spaced apart from each other, each having a shape adapted loosely to accommodate and support an extension of a corresponding one of said locking members.

3. A cylinder lock as recited in claim 1, wherein said cylinder has a plurality of vertical openings for dividing the integral peripheral wall of said cylinder into a plurality of equal arciform portions, each arciform portion having an outer peripheral surface provided with a plurality of annular grooves, and said guide means comprises a plurality of arciform snap members being respectively engaged into said annular grooves, each one of said snap members having two opposite ends bent inwardly to abut against the corresponding side surface of said arciform portion and extending into said second center bore to retain and guide the corresponding locking members.

* * * * *